United States Patent [19]

Douglas et al.

[11] Patent Number: 4,850,170

[45] Date of Patent: Jul. 25, 1989

[54] STRUCTURAL MEMBERS AND CONSTRUCTION METHODS

[76] Inventors: Hugh W. Douglas; Alan F. Spedding, both of P.O. Box 1581, Rotorua, New Zealand

[21] Appl. No.: 233,956

[22] Filed: Aug. 18, 1988

Related U.S. Application Data

[63] Continuation of Ser. No. 16,216, Feb. 19, 1987, abandoned.

[51] Int. Cl.[4] ..... E04B 1/10

[52] U.S. Cl. ..... 52/427; 52/227; 52/562; 52/595; 52/533

[58] Field of Search ..... 52/233, 227, 562, 426, 52/563, 564, 595, 533, 427, 425, 593, 539, 690

[56] References Cited

U.S. PATENT DOCUMENTS

| | | | |
|---|---|---|---|
| 335,342 | 2/1886 | Daugherty | 52/593 X |
| 576,569 | 2/1897 | Gemmer | 52/593 |
| 2,243,316 | 5/1941 | Larsen | 52/595 X |
| 3,002,322 | 10/1961 | Dorsett | 52/227 |
| 3,286,428 | 11/1966 | Kay | 52/562 X |
| 3,603,060 | 9/1971 | Kay | 52/562 X |
| 3,621,626 | 11/1971 | Tylius | 52/227 |
| 3,676,967 | 7/1972 | Frati | 52/426 X |
| 4,223,501 | 9/1980 | DeLozier | 52/426 X |
| 4,442,644 | 4/1984 | Jukes | 52/562 X |
| 4,517,780 | 5/1985 | Lacombe et al. | 52/233 |

*Primary Examiner*—Carl D. Friedman

*Attorney, Agent, or Firm*—Abelman, Frayne, Rezac & Schwab

[57] ABSTRACT

A structural member and a method of construction employing same, wherein the structural member comprises two boards held in spaced apart relationship by a pluarlity of spacers fixed at intervals between said boards and each board has a tongue along one edge and a complementary groove along the other, and wherein said structural members can be readily joined edge to edge to construct walls and partitions.

8 Claims, 5 Drawing Sheets

STRUCTURAL MEMBERS AND CONSTRUCTION METHODS

This application is a continuation of application Ser. No. 016,216, filed Feb. 19, 1987 now abandoned.

This invention concerns structural members and methods of construction involving same.

It is an object of the present invention to provide a strutural member for use in the construction of walls and partitions in a variety of structures, including houses in particular.

Further objects and advantages of the present invention will become apparent from the ensuing description which is given by way of example.

This invention provides a structural member and a method of construction employing same, wherein the structural member comprises two boards held in spaced apart relationship by a plurality of spacers fixed at intervals between said boards and each board has a tongue along one edge and a complementary groove along the other, and wherein said structural members can be readily joined edge to edge to construct walls and partitions.

Figure 1:
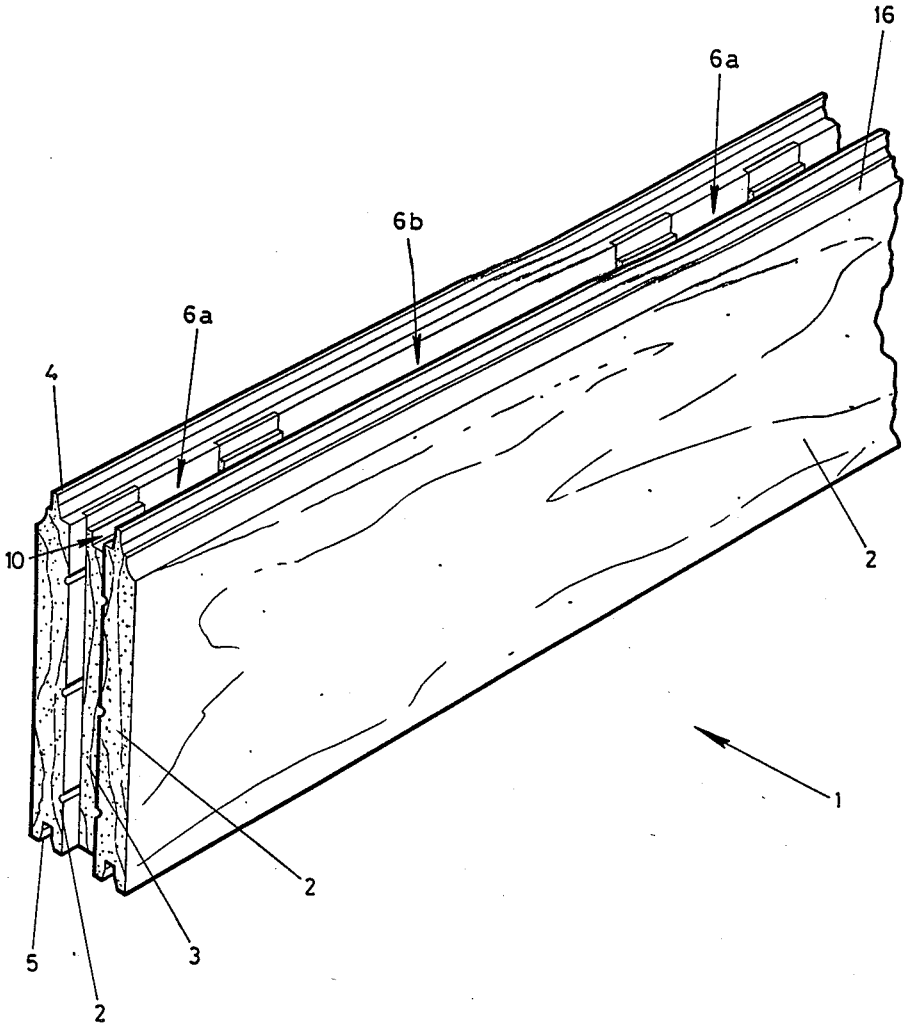
Figure 2:
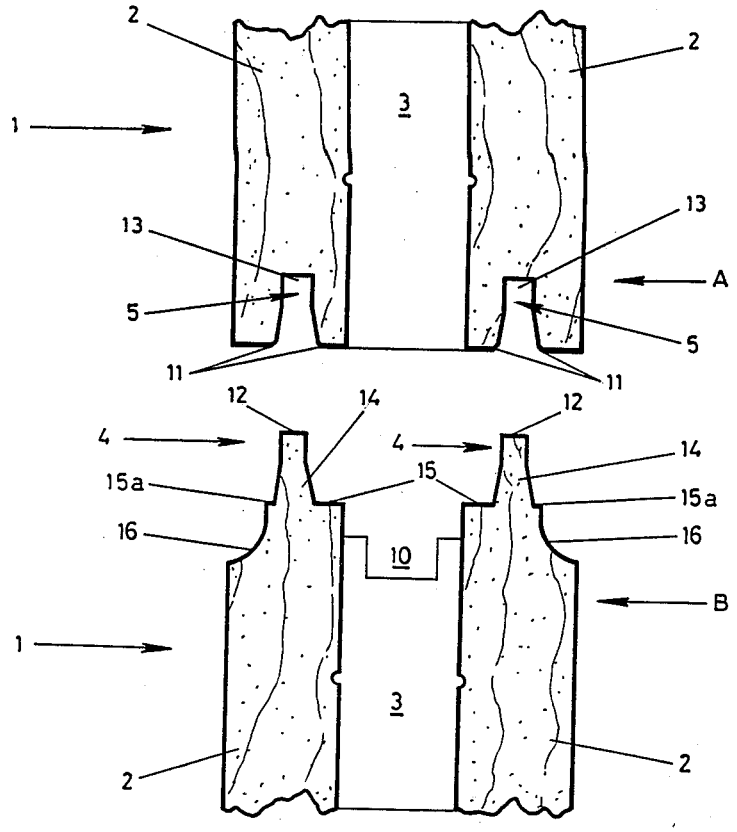
Figure 3:
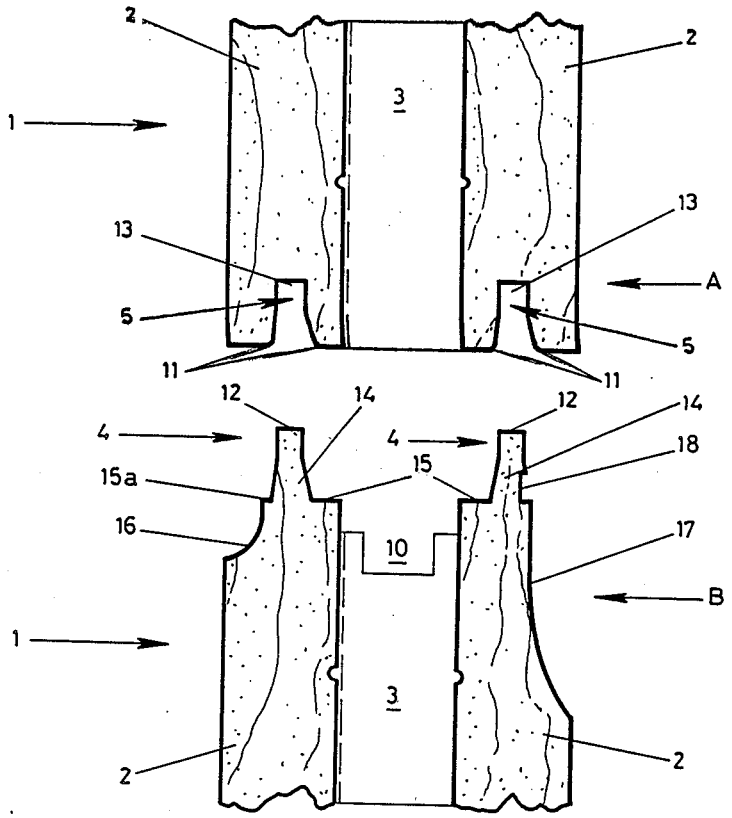
Figure 4:
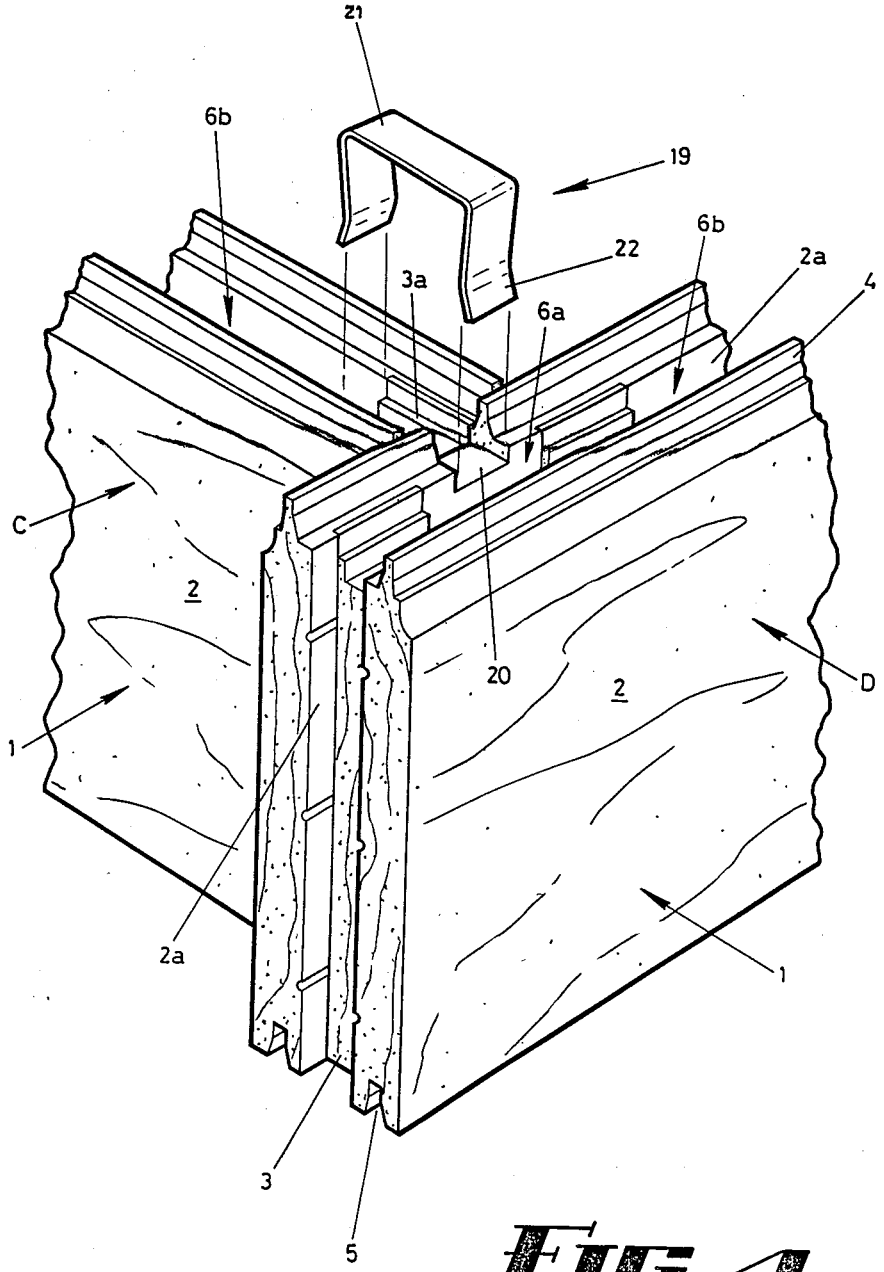
Figure 5:
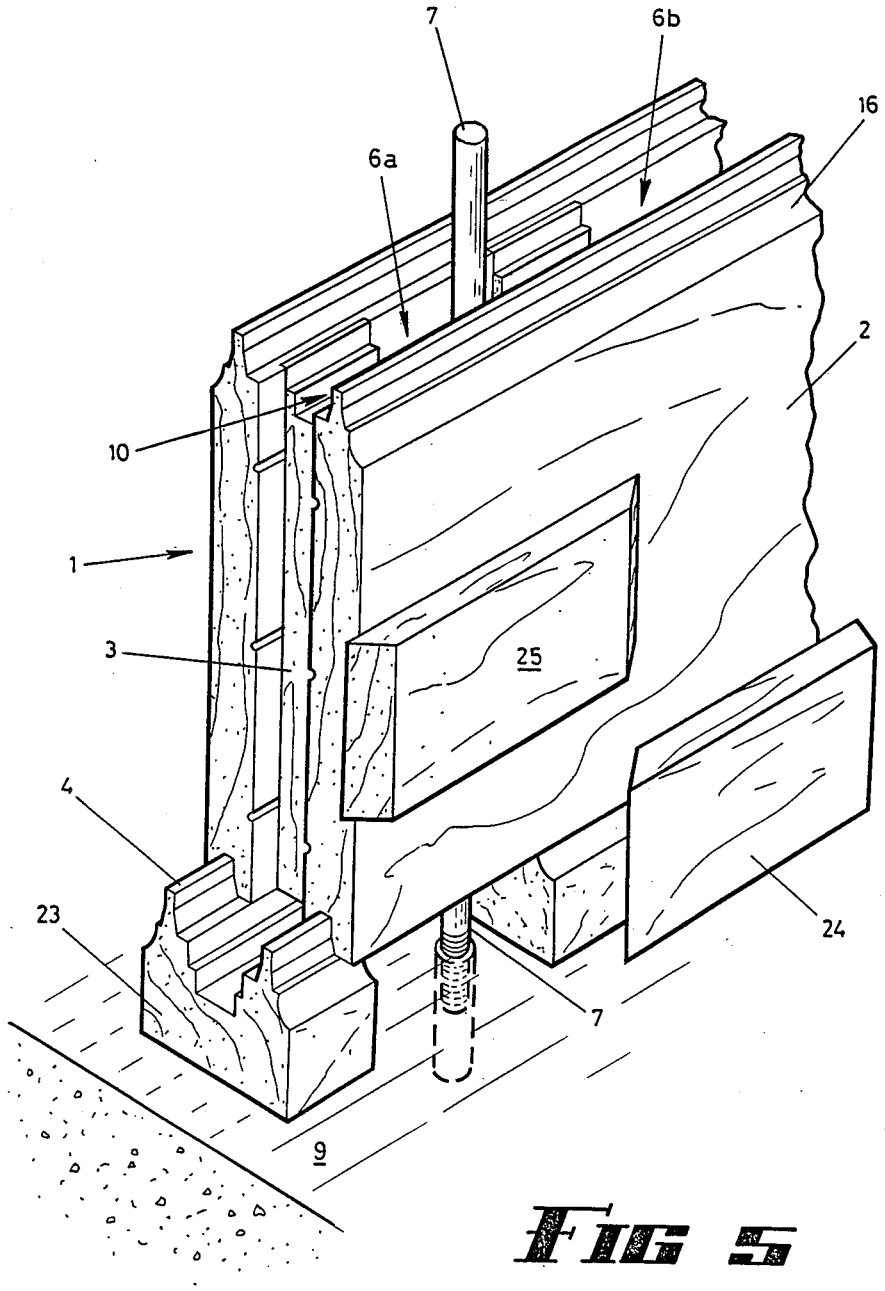

Preferred embodiments of various aspects of the present invention will now be described with reference to the accompanying drawings in which:

FIG. 1 is a perspective view of a section of one structural member in accordance with one possible embodiment of the present invention, and FIG. 2 is an end view of inter-engaging structural members in accordance with one possible embodiment of the present invention showing detail of the tongue and groove arrangement, and FIG. 3 is an end view of the inter-engaging structural members shown in FIG. 2 in which there is shown preferred adaptations to a structural member to make it suitable for use in the construction of a wall section with an exterior face, and FIG. 4 is a diagrammatic perspective view of intersecting structural members showing one possible embodiment of a wall connector for use therewith, and FIG. 5 is a diagrammatic perspective view of a tie rod and masonry anchor in accordance with one possible embodiment of the present invention.

The present invention relates to a construction method which uses inter-engaging structural members generally indicated by arrow 1 that abut edge to edge to create wall sections (not shown).

Each structural member 1 is made up of two parallel spaced apart boards 2 interconnected by a plurality of spacers 3 that are fixed at intervals between the boards 2. The structural members in a wall section are mutually engageable by means of a tongue 4 and groove 5 arrangement located along the abutting edges of the boards.

The spacers 3 are located at regular intervals inside the structural members 1 so that when the structural members are abutted edge to edge so as to form a wall section, the spacers 3 inside each structural member are alignable thereby providing between the spacers, cavities (generally indicated by arrow 6) which extend through the wall sections, and in which tie rods 7 and/or locking members can be located.

A locking member may comprise either a modified H-shaped body locatable between abutting structural members and capable of engaging one or more spacers in both abutting structural members, or in a more simpler form it can comprise a rigid shaft which is adapted to fit inside the cavities *6a* of a wall section: both serve to prevent independent horizontal movement (herein 'racking') of one structural member with respect to another, as well as making the wall sections more rigid. The shaft-type locking member can also be used as a blank into which screws can bite.

The wall sections are secured to a floor 9 by means of tie rods 7 which are locatable in the cavities 6 of the wall sections, and which interconnect the floor 9 with the top of the wall section or roof trusses (not shown).

Various aspects of a preferred embodiment of the present invention will now be described in greater particularity with reference firstly to the structural members shown in FIGS. 1 and 2.

A structural member 1 comprises two parallel spaced apart boards 2 interconnected by a plurality of spacers 3. Each board 2 of each structural member 1 is provided with a tongue generally indicated by arrow 4 along one edge and a groove generally indicated by arrow 5 along its other edge such that adjacent structural members are mutually engageable.

The spacers 3 are arranged in pairs at intervals between the boards 2. In the embodiment shown in FIG. 1, each spacer in a pair is approximately 5 cm apart and each pair of spacers is located at intervals of approximately 20 cm from the next pair of spacers. The intervals at which the spacers are placed in each structural member are regular so that when one structural member is positioned with respect to others so as to form a wall section, the spacers in each structural member are alignable with the spacers in the other structural members thereby creating cavities or channels *6a* and *6b* which extend vertically through the wall section.

The spacers 3 comprise lengths of square section timber. They are fixed between the two boards of a structural member by being seated in trenches (not clearly shown in the drawings) in the boards which accommodate the spacers in a snug fit. Adhesives are used to bond the spacers in the trenches.

In each spacer 3 of each structural member, aligned rebates or apertures generally indicated by arrow 10 are provided so that wires (not shown) or tie rods can be laid horizontally through the structural members.

The rebates 10 shown in the drawings comprise knotches or channels cut out of the top of each spacer in a structural member. Alternatively, apertures and/or rebates (not shown) may be located in other suitable locations in the body of the spacers.

A variety of benefits accrue from having aligned rebates 10 in the spacers 3 of each structural member 1. For instance, during construction of a wall section electric wires and the like can be laid horizontally through a structural member as well as vertically through the cavities 6 between the spacers in the wall sections. The rebates 10 can also accommodate horizontally disposed tie rods through the structural members which can be used to interconnect intersecting wall sections/structural members one to the other and provide added strengthening to the overall structure.

As described earlier, a wall section is made up of structural members which are fitted edge to edge by means of a tongue and groove arrangement located along the abutting edges. The embodiment shown in the drawings discloses tongue and groove boards wherein the mouth 11 of each groove 5 is significantly wider than the tip 12 of the tongue 4 in each board so that the tongues are more readily aligned with and received into the flared mouths 11 of the grooves. This feature is particularly useful where boards are warped or for other reasons are difficult to align one with the other when attempting to unite them along their abutting edges.

Referring to FIG. 2, the groove 5 has a lower channel section 13 with straight parallel sides which extend to approximately the mid-point of the groove, at which point the sides flare outwards towards the mouth 11. Conversely, the tongue 4, in a manner complementary with the groove 5, has a base 14 which is wider than its tip 12: the base 14 tapers inwardly approximately to its mid-point from where the sides of the tongue extend parallel to its tip 12. The tongue is adapted to be received into the groove in a tight fit and in this regard the base 14 of the tongue is only marginally narrower than the mouth 11 of the groove to avoid causing the groove to split. However, it should be appreciated that where the boards 2 are fabricated from softer materials (such as soft woods), the base section of the tongue can be slightly wider than the mouth of the groove so that it can be jammed in place to effect a very tight fit.

Once the tip portion 12 of the tongue of a first structural member is in position in the mouth 11 of the groove of an abutting structural member, the structural members can be forced together to ensure that the tongue is fully seated in its adjacent complementary groove and that each structural member is properly united with its adjacent member. It is noted that when tensioning vertical tie rods 7 which extend from the floor section 9 to above a constructed wall section this action also draws and holds the structural members together and forces the tongues into their adjacent grooves.

As shown in FIG. 2 the upper edge of each board 2 in a structural member has shoulders 15 which extend out from the base of the protruding tongue 4. The shoulders 15*a* which face outwardly with respect to the structural member 1 terminate at a rebate 16 which is cut into the outer corner of said outer shoulder 15*a*.

The rebates 16 shown in the drawings are scallop shaped, but it should be appreciated that other shaped rebates are suitable and to a large extent the shape is a matter of designer choice.

Structural members 1 and boards 2 as described herein can be used to form wall sections with an exterior face. The suitability of a structural member for use in external walls is enhanced by minor alteration to the external board in the general area of the rebate 16. The alteration involves removing the outer shoulder 15*a* and the rebate 16 normally present therein, by bevelling or planing, such that the outer board face is steeply tapered from its upper edge as shown in FIG. 3. This adaption improves the weatherproof characteristics of interconnected boards, by providing a substantial overhang of the upper part of a first outer board (A) by the lower edge of a subsequent outer board (B) when united edge to edge to form a wall section. Furthermore, removal of the outer shoulder 15*a* from board (A) ensures that there is no shoulder beneath subsequent board (B) on which water may collect and be soaked up into the subsequent board (B).

When the shoulder 15*a* and rebate 16 is removed as aforesaid it leaves a structural member (hereinafter referred to as a bevel edged structural member) which has an outer board whose outer shoulder 17 inclines steeply from about the base 14 of the tongue to the outer face of the board. The profile of the adapted shoulder 17 can be flat, or curved as in FIG. 3.

A bevel edged structural member may include an anti-capillarity groove 18 in its tongue, to prevent water rising into the wall section between the tongue and the groove.

A structural member can be further specifically adapted for use in forming exterior walls by the inclusion of a layer of weather-proof material of insulation on the interior surface of at least one board in a structural member.

Interior partition wall sections (shown in FIG. 5) are finished off with suitable cappings (now shown). A capping for instance can be fitted over the exposed ends of the internal partition wall section: cappings are also used to provide door and window jambs.

When wall sections or structural members (hereinafter referred to as interesting wall sections or intersecting structural members—whichever is appropriate, and identified by the letter C) meet on an angle with other wall sections/structural members (hereinafter referred to as intersected wall sections or intersected structural members, and identified by the letter D) as for instance occurs where there are internal partitions (refer FIG. 4) or corners, the ends of said intersecting structural members (C) are received into a trench (not clearly shown in the drawings) located in the intersected structural member (D). The trench is approximately 3 mm deep and is adapted to receive the end of an intersecting structural member (C) in a snug fit.

Wall connectors 19 are used to hold the intersecting structural member (C) of a wall section with respect to an intersected structural member (D). The wall connectors 19 are adapted so that they can be positioned in a push fit over the end spacer 3*a* of an intersecting structural member (C) and the abutting board 2*a* of an intersected structural member (D).

A recess (not clearly shown in the drawings but generally indicated at 20) in the upper edge of the abutted board 2*a* of the intersected structural member is required to accommodate the horizontal part 21 of the connector body. Said recess 20 can be made in the intersected structural member (D) at the same time that the trench for accommodating the edge of the intersecting structural member (C) is being routed in the abutting board 2*a*. In the embodiment shown, the end spacer 3*a* does not require a recess similar to recess 20 in the abutted board, as the spacers 3 do not extend above the shoulder 15 of the boards 2.

Wall connectors can have a variety of forms. A simple form of wall connector is shown in FIG. 4 and comprises an inverted "U" shaped clip with partially flared sides 22. An alternative form (not shown) may comprise what is substantially an "H" shaped connector: this form has the advantage of being able to hold together structural members from above and below.

An "H" shaped connector is able to hold intersecting structural members together between its vertical sides from both above and below the said structural members. The use of such connectors prevents racking by individual structural members in a wall section.

Wall connectors having the same or similar form to those described above can be used to join two structural members/wall sections end to end, being adapted to straddle and hold the end spacers of two structural members which are abutted end to end.

It should also be appreciated that fastening means such as nails, screws, nuts and bolts can be used to join intersecting and adjoining structural members.

As described earlier the spacers 3 are located in pairs at regular intervals between the boards of the structural members. Their regular placement inside the structural members enables the spacers to be readily aligned when one structural member is united with another so as to form a wall section, thereby providing longitudinal cavities or channels between the spacers which extend through the wall sections. There are consequently two sizes of cavities, a narrower cavity *6a* which is defined between the two spacers of a pair and a wider cavity *6b* defined between the pairs of spacers.

Both cavities *6a* and *6b*, and particularly the larger cavities *6b*, can be filled with an insulation material which for instance can be effected in situ after the wall sections have been formed.

In the narrower cavities *6a* a tie rod 7 can be readily accommodated. This tie rod 7 interconnects a floor 9 with the top of the wall section or with the ceiling supports. The narrower cavities *6a* can be used to accommodate locking members (of the rigid shaft type aforedescribed) which provide a wall section with greater rigidity and strength, and prevent racking by one or more structural members with respect to the others.

The wall sections are fixed to a floor 9 by means of the tie rods 7 which are fixed at the top of a wall section or to the ceiling supports, and are anchored to the floor.

The structural member at the bottom of a wall section can be seated on a base plate 23 as shown in FIG. 5. Skirting board 24 is used to conceal the exposed edge of the bottom structural member. The skirting board includes a removable section 25 which permits ready access to the tie rod 7 at the point where it is anchored to the floor 9.

Aspects of the present invention have been described by way of example only and it will be appreciated that modifications and additions thereto may be made without departing from the spirit or scope thereof as defined in the appended claims.

We claim:

1. In a structural member comprising two boards, each having a tongue arrangement extending longitudinally thereof at one of the uppermost and lowermost edges of each said board, and a groove arrangement extending longitudinally thereof at the opposite edge of said tongue arrangement, the improvement comprising:

a plurality of spacers, each in the form of a single solid stud of substantially rectangular cross-section interposed between said boards in closely spaced pairs at regular intervals, and secured to said boards to provide a rigid assembly;

each said structural member containing at least two of said pairs of spacers, the respective pairs of spacers being spaced more widely from each other pair of spacers than the spacing of the respective spacers of the respective pairs of spacers from each other;

each spacer having a rebate in at least one axial end thereof;

whereby, said structural members, when assembled one to the other provide both vertical and lateral channels for the reception of ancilliary members of an assembled structured for the purpose of preventing racking of a structure assembled from said structural members.

2. The structural member of claim 1, in which each said spacer is substantially square in cross-section.

3. The structural member as claimed in claim 1, in combination with at least one other said structural member, wherein the tongue of each said board is interfitted into a groove of a mutually presented other said board.

4. The structural member of claim 3, further including a tie rod extending between at least one pair of said pairs of spacers and operative to hold said structural members assembled one to the other in a compressed relationship.

5. The structural member of claim 3, further including a tie rod extending through aligned rebates of respective said spacers and operative to hold said structural members assembled to other ones of said structural members.

6. The structural member of claim 3, in which each tongue is tapered towards its free edge, and each groove has an outwardly flared mouth for the ready reception of a said tongue.

7. The structural member of claim 3, in which each tongue has an anti-capillarity groove in the base thereof, and the board inclines steeply from the base of the tongue to the outer face of the board on that side of the board which is to face outwardly, the arrangement being such that where such members are united edge to edge, the exposed joint is substantially weatherproof.

8. The structural member of claim 3, further including a skirting board positioned at a base of a wall section assembled from said structural members, said skirting board having removable sections to provide access to tie rods employed for holding said structural members in assembled compressed relation.

* * * * *